United States Patent [19]

Copeland

[11] Patent Number: 4,733,729

[45] Date of Patent: Mar. 29, 1988

[54] MATCHED PARTICLE/LIQUID DENSITY WELL PACKING TECHNIQUE

[75] Inventor: Claude T. Copeland, Broken Arrow, Okla.

[73] Assignee: Dowell Schlumberger Incorporated, Tulsa, Okla.

[21] Appl. No.: 11,392

[22] Filed: Feb. 4, 1987

Related U.S. Application Data

[63] Continuation-in-part of Ser. No. 905,355, Sep. 8, 1986, abandoned.

[51] Int. Cl.[4] ..... E21B 43/04

[52] U.S. Cl. ..... 166/276; 166/278

[58] Field of Search ..... 166/276, 278, 285, 292, 166/50, 51; 252/8.551

[56] References Cited

U.S. PATENT DOCUMENTS

| | | | |
|---|---|---|---|
| 1,108,358 | 10/1965 | Sluder . | |
| 1,108,359 | 10/1965 | Sluder . | |
| 2,823,753 | 2/1958 | Henderson et al. . | |
| 3,127,937 | 4/1965 | McGuire et al. . | |
| 3,237,693 | 3/1966 | Huitt et al. . | |
| 3,285,340 | 11/1966 | Huitt et al. . | |
| 3,327,783 | 6/1967 | Ayers . | |
| 3,335,796 | 8/1967 | Parker . | |
| 3,354,959 | 11/1967 | Fast et al. . | |
| 3,391,738 | 7/1968 | Sparlin . | |
| 3,399,727 | 9/1968 | Graham et al. . | |
| 3,404,735 | 10/1968 | Young et al. . | |
| 3,621,916 | 11/1971 | Smith . | |
| 3,625,873 | 12/1971 | Wilson . | |
| 3,659,651 | 5/1972 | Graham . | |
| 3,760,880 | 9/1973 | Dollarhide . | |
| 3,867,986 | 2/1975 | Copeland . | |
| 4,016,931 | 4/1977 | Cryar, Jr. | 166/276 |
| 4,074,060 | 2/1978 | Eissert et al. . | |
| 4,074,760 | 2/1978 | Copeland et al. . | |
| 4,081,030 | 3/1978 | Carpenter et al. . | |
| 4,216,829 | 8/1970 | Murphey | 166/276 |
| 4,220,556 | 9/1980 | Oswald et al. . | |
| 4,368,136 | 2/1983 | Murphey . | |
| 4,547,468 | 10/1985 | Jones et al. . | |
| 4,589,490 | 5/1986 | Darr et al. | 166/276 |

FOREIGN PATENT DOCUMENTS 740258 8/1966 Canada .

OTHER PUBLICATIONS

SPE 6805 Design of Gravel Packs . . . Wells by Gruesbeck et al.

SPE 7006 Particle Transport Through Perforations by Gruesbeck.

SPE 10654 Gravel Transport in Deviated Wellbores by Hodge

SPE 11009 Aspects of Slurry and Particle Setting and Placement for Viscous Gravel Packing by Robert S. Torrest.

SPE 14162 Recent Design, Placement, and Evaluation Techniques Lead to Improved Gravel Pack Performance by L. B. Ledlow and C. W. Sauer.

Factors to Consider in the Effective Gravel Packing of Deviated Wells by M. B. Dyeneyin.

How Propping Agents Affect Packed Fractures by I. R. Dunlap.

Well Stimulation in the North Sea–Petroleum Eng., pp. 58–68, by A. K. Johnson and K. K. LaFleur.

Lightweight Proppants for Deep Gas Well Stimulation by A. H. Jones et al.

Composition and Properties of Oil Well Drilling Fluids–4th Edition.

*Primary Examiner*—George A. Suchfield

*Attorney, Agent, or Firm*—S. A. Littlefield

[57] ABSTRACT

A method of packing a deviated well, particularly an oil, gas or water well. A particle/liquid slurry is injected into the wellbore, the particle density to liquid density ratio of which is no greater than about 2 to 1. The particles have a coating of adhesive on them. The particles are strained out of the slurry in the wellbore, so as to produce a packed mass of the particles adjacent the formation. The packed mass is such as to allow flow of fluids therethrough between the formation and the wellbore, while substantially preventing particulate material from the formation passing therethrough and into the wellbore. The fluid density is preferably about 0.8 to about 1.2 g/cm$^3$.

25 Claims, 1 Drawing Figure

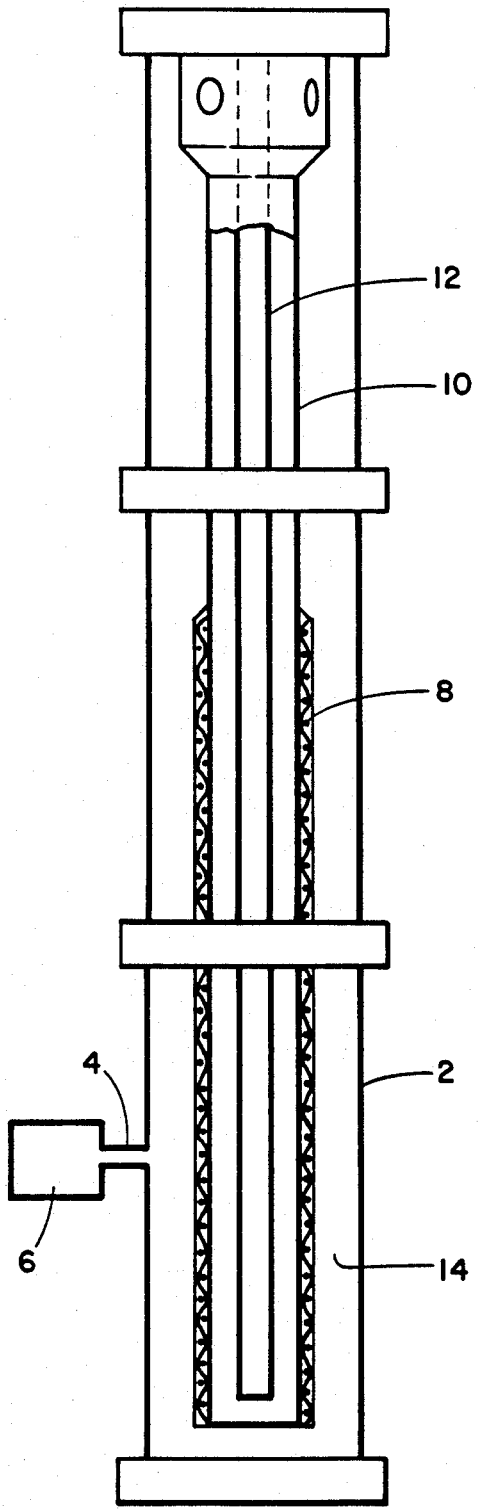
12
10
8
4
2
6
14

MATCHED PARTICLE/LIQUID DENSITY WELL PACKING TECHNIQUE

This is a continuation-in-part of co-pending application Ser. No. 905,355 filed on Sept. 8, 1986, now abandoned.

FIELD OF THE INVENTION

This invention relates to a method for packing wells, particularly oil, gas or water wells, in which the density of adhesive coated packing particles and the carrier liquid is matched within certain defined ranges. The invention is applicable to both production and injection wells.

TECHNOLOGY REVIEW

The technique of packing a well, such as an oil, gas, or water well, has been well known for many years. In such a technique, a particulate material is produced between the earth formation and a point in the wellbore. The particle size range of the particulate material is preselected, and it is produced in such a manner, so that the packed material will allow flow of the desired fluid (the term being used to include liquids and/or gases) between the formation and the wellbore, while preventing particulate materials from the earth formation from entering the wellbore.

In the particular application of this technique to pack a well, typically a screen is first placed at a position in the wellbore which is within the formation. In completed wells, a perforated steel casing is usually present between the so placed screen and formation. A slurry of the particulate material in a carrier liquid is then pumped into the wellbore so as to place the particulate material between the screen and casing (or formation if no casing is present), as well as into the perforations of any such casing, and also into any open area which may extend beyond the perforated casing into the formation. Thus, the aim in packing in most cases, is to completely fill up the area between the screen assembly and the formation with the particulate material. In some cases this open area is packed with particulate material before placing the screen in the well. Such a technique, which is a particular type of packing, often referred to as "pre-packing", is described in U.S. Pat. No. 3,327,783. The particulate material is typically gravel having a density (D) of about 2.65 grams per cubic centimeter (g/cm$^3$). The carrier liquid is generally water with a density of 1 g/cm$^3$. The gravel particle size range is generally 20 mesh (all mesh sizes, U.S. mesh unless otherwise specified) to 40 mesh (841 microns to 420 microns) or 40 mesh to 60 mesh (420 microns to 250 microns). The resulting density ratio of particulate material to carrier liquid ($D_p/D_c$), is about 2.65/1.

In many cases the overall packing efficiency (the percentage of the total volume of the area between the screen and the formation that is filled with gravel) is less than 100 percent (%). This is particularly true for deviated wells, and especially for highly deviated wells (those deviating from the vertical at an angle of more than about 45°). Of course, the lower the packing efficiency, the greater the likelihood of low production or injection rates and/or sand movement into the wellbore and production string.

Apparently, there has been no prior disclosure in well packing, of the use of packing materials and carrying liquids with closely matched densities, particularly in deviated wellbores. This is further particularly the case where both the carrier liquid and particulate packing material have low densities (for example both close to 1 g/cm$^3$). It has been discovered that where the foregoing densities are matched within defined ranges, greater packing efficiencies can be obtained. Further, where low density particulate packing materials are used, water can be used as the carrier liquid and the greater packing efficiencies still obtained. Thus, the addition of viscosifiers to the carrier liquid can be reduced or eliminated while still obtaining high packing efficiencies.

SUMMARY OF THE INVENTION

The present invention provides a method of packing a well, a portion of which penetrates an earth formation at an angle to the vertical. The method comprises injecting into the wellbore a slurry of particles in a liquid. This slurry has a particle density to liquid density ratio of no greater than about 2 to 1. The particles used have a coating of adhesive. The particles are then strained out of the slurry, typically by the screen and/or formation, so as to produce a packed mass of the particles adjacent the formation. The packed mass is such as to allow flow of fluids therethrough between the formation and wellbore, while preventing particulate material from the formation passing therethrough and into the wellbore.

One form of adhesive which can be used is that which requires treatment with a catalyst before becoming effective. In such case the method additionally requires the pumping of a catalyst down the bore after the particles have been strained out, in order to activate the adhesive and rigidify the packed mass. An alternate adhesive which might be used is one which will set over time after the particles have been strained out in the bore.

The density of the particles is preferably less than about 2 g/cm$^3$. Further preferably, the density of the particles is between about 0.7 to about 2 g/cm$^3$. The liquid may preferably have a density of about 0.8 to about 1.2 g/cm$^3$.

Of the many liquids which can be used, water is preferred, either viscosified or unviscosified, but usually the former. The liquid may contain additives for friction reduction which may also act as viscosifiers. The particulate material used desirably has a Krumbein roundness and sphericity each of at least about 0.5, and preferably at least about 0.6. That is, the particles of the material have a roundness and sphericity as determined using the chart for estimating sphericity and roundness provided in the text *Stratigraphy And Sedimentation,* Second Edition, 1963, W. C. Krumbein and L. L. Sloss, published by W. H. Freeman & Co., San Francisco, CA, USA.

The method is particularly advantageously applied to wells which pass through the formation at an angle to the vertical of greater than about 45°, and especially those at angles to the of greater than about 75°.

DRAWING

The FIGURE is a schematic cross-section of a model used to simulate a portion of a well in which packing may be placed in accordance with the present inventive technique.

DETAILED DESCRIPTION OF EMBODIMENTS OF THE INVENTION

In order to ascertain the effects of varying the density ratio of packing particles and carrier liquid, in a wellbore, a transparent plastic test model was used. The model basically emulated, in plastic, many components of a cased well prepared for packing. The model included an elongated hollow tube serving as a casing 2, with a number of tubes extending radially therefrom, acting as perforations 4. Perforation chambers 6 communicate with each perforation 4. For simplicity, only one perforation 4 and its corresponding chamber 6 is shown in the Figure. However, the model had a total of 20 perforations, arranged in 5 sets. Each set consists of 4 coplanar perforations spaced 90° apart from one another, the sets being spaced one foot apart along a 5 foot section of the hollow tube serving as the casing 2, starting one foot from the bottom of the model. Each perforation has a perforation chamber 6 in communication therewith. The model further had a wire screen 8 extending from a blank pipe 10, and washpipe 12 extending into screen 8. The annular space between the screen 8 and casing 2, defines a screen-casing annulus. The entire model was arranged so that it could be disposed at various angles to the vertical.

The model was operated in a number of tests, using US Mesh 20-40 gravel, or US Mesh 18-50 styrene-divinylbenzene copolymer (SDVB) beads obtained from The Dow Chemical Company (Product Number 81412), in place of the gravel. Four tests were performed, three with the model at an angle of 75° to the vertical, and one at an angle of 90° thereto. In the first test, gravel with a density of 2.65 g/cm$^3$ was used in combination with a carrier liquid of viscosified water (density 1.0 g/cm$^3$). The foregoing (Test 1) typifies a current field operation. Tests 2 and 3 used SDVB beads with viscosified and unviscosified water, respectively. The model was disposed at angles of 75° and 90°, respectively to the vertical. Test 4 used gravel of the type used in Test 1, with the wellbore being disposed at the same angle to the vertical as in Test 1. Also, Test 4 used an aqueous calcium chloride brine instead of water, such that the particle density to carrier liquid density ($D_p/D_c$) ratio was about 1.97. The test conditions of Tests 1–4 are summarized below in Table 1. Tables 2 and 3 below, respectively provide the perforation chamber packing efficiency and liquid leakoff, for each perforation. The data from Tables 2 and 3 are consolidated and summarized in Table 4 below. The reference in Table 4 to various "rows" of perforations, is to a colinear group of five perforations.

TABLE 2

Perforation Chamber Packing Efficiency

| Perforation Number[1] | Perforation Chamber Packing Efficiency (% Filled) Test 1 | Test 2 | Test 3 | Test 4 |
|---|---|---|---|---|
| 1T | 0 | 45 | 20 | 10 |
| 1L | 10 | 40 | 75 | 30 |
| 1R | 10 | 40 | 20 | 30 |
| 1B | 25 | DI* | 45 | 30 |
| 2T | 0 | 40 | 20 | 10 |
| 2L | 10 | 50 | 75 | 30 |
| 2R | 4 | 55 | 45 | 20 |
| 2B | 25 | DI* | 30 | 25 |
| 3T | 0 | 45 | 20 | 10 |
| 3L | 12 | 45 | 95 | 20 |
| 3R | 6 | 55 | 45 | 25 |
| 3B | 20 | 80 | 25 | 20 |
| 4T | 0 | 30 | 20 | 0 |
| 4L | 12 | 45 | 50 | 20 |
| 4R | 15 | 60 | 25 | 25 |
| 4B | 20 | DI* | 50 | 10 |
| 5T | 0 | DI* | 20 | 0 |
| 5L | 0 | 30 | 20 | 0 |
| 5R | 15 | 65 | 55 | 25 |
| 5B | 20 | DI* | 25 | 10 |

[1]The members of each set of four coplanar perforations are each assigned a number, starting with 1 for the members of the set which are lowermost on the casing. Each member of each set of perforations is then assigned a letter (T = top; B = bottom; L = left; R = right) designating its position during the tests relative to the other perforations of its set.

*Data ignored because of perforation plugging during test due to mechanical problem.

TABLE 3

Leakoff Volume Thru Perforation

| Perforation Number | Leakoff Volume (ml) Test 1 | Test 2 | Test 3 | Test 4 |
|---|---|---|---|---|
| 1T | 500 | 1000 | 750 | 2100 |
| 1L | 750 | DI* | 950 | 700 |
| 1R | 850 | 900 | 300 | 400 |
| 1B | 500 | DI* | 900 | 500 |
| 2T | 500 | 500 | 950 | 750 |
| 2L | 900 | 800 | 1000 | 1000 |
| 2R | 850 | 700 | 1000 | 200 |
| 2B | 500 | DI* | 500 | 400 |
| 3T | 500 | 600 | 950 | 2300 |
| 3L | 1000 | 1000 | 1100 | 300 |
| 3R | 750 | 700 | 600 | 500 |
| 3B | 750 | DI* | 350 | 400 |
| 4T | 800 | 700 | 1200 | 500 |
| 4L | 750 | 500 | 700 | 600 |
| 4R | 750 | 1000 | 550 | 900 |
| 4B | 600 | DI* | 925 | 500 |
| 5T | 600 | DI* | 500 | 900 |
| 5L | 1000 | 700 | 400 | 200 |

TABLE 1

TEST CONDITIONS-HIGH PRESSURE WELLBORE SIMULATOR

| | Test 1 | Test 2 | Test 3 | Test 4* |
|---|---|---|---|---|
| (A) Particulate | Gravel | SDVB | SDVB | Gravel |
| Concentration, lb/gal (kg/l) | 2.5(0.3) | 1.0(0.12) | 1.0(0.12) | 2.5(0.3) |
| Concentration, cu ft/gal (cm$^3$/l) | 0.0153(0.114) | 0.0153(0.114) | 0.0153(0.114) | 0.0153(0.114) |
| Density (g/cm$^3$) | 2.65 | 1.05 | 1.05 | 2.65 |
| (B) Carrying Fluid | Water | Water | Water | $CaCl_2$ |
| Density, (g/cm$^3$) | 1.0 | 1.0 | 1.0 | 1.34 |
| Carrier viscosified | yes | yes | no | yes |
| Viscosifier | HEC[1] | HEC | — | HEC |
| Viscosifier Conc, lb/1000 gal (kg/l) | 40(4.8) | 40(4.8) | — | 24(2.88) |
| Viscosity, Fann 35 viscometer @ 100 rpm (centipoise) | 90 | 90 | 1 | 90 |
| (C) $D_p/D_c$ Ratio | 2.65 | 1.05 | 1.05 | 1.97 |
| (D) Wellbore, Deviation from vertical, degrees | 75° | 75° | 90° | 75° |
| (E) Pump Rate, barrels per minute | 2 | 2 | 2 | 2 |
| (F) Leakoff, gal/min (liters/min)/perforation | 0.1(0.38) | 0.1(0.38) | 0.1(0.38) | 0.1(0.38) |

[1]HEC = hydroxyethylcellulose

TABLE 3-continued

| Perforation Number | Leakoff Volume Thru Perforation Leakoff Volume (ml) Test 1 | Test 2 | Test 3 | Test 4 |
|---|---|---|---|---|
| 5R | 1000 | 1500 | 700 | 1100 |
| 5B | 700 | DI* | 500 | 2150 |

[1]The members of each set of four coplanar perforations are each assigned a number, starting with 1 for the members of the set which are lowermost on the casing. Each member of each set of perforations is then assigned a letter (T = top; B= bottom; L = left; R = right) designating its position during the tests relative to the other perforations of its set.

*Data ignored because of perforation plugging during test due to mechanical problem.

TABLE 4

| TEST RESULTS | Packing Efficiency (%) Test 1 | Test 2 | Test 3 | Test 4* |
|---|---|---|---|---|
| Perforations | | | | |
| Top row | 0 | 100 | 100 | 60 |
| Left row | 80 | 100 | 100 | 100 |
| Right row | 80 | 100 | 100 | 100 |
| Bottom row | 100 | 100 | 100 | 100 |
| Overall | 65 | 100 | 100 | 90 |
| Perforation Chambers | | | | |
| Top row | 0 | 40 | 20 | 6 |
| Left row | 10 | 44 | 55 | 20 |
| Right row | 10 | 54 | 38 | 25 |
| Bottom row | 23 | 80 | 35 | 25 |
| Overall | 10 | 54 | 37 | 19 |
| Screen-Casing Annulus | | | | |
| Overall | 100 | 100 | 100 | 100 |

It is apparent first from comparing the results of Tests 2 and 3 ($D_p/D_c=1.05$) with those of Test 1 ($D_p/D_c=2.65$), that using the lower density SDVB beads in place of the gravel used in Test 1, resulted in far better packing efficiency in Tests 2 and 3. This is true even though Test 3 was performed with the model disposed at a 90° angle to the vertical, versus the 75° to the vertical angle of the model in Test 1. Furthermore, it will be seen from Test 4, which used the same gravel as in Test 1 but with a densified carrier liquid (brine solution), that the $D_p/D_c$ ratio can be effectively lowered by increasing the density of the carrier liquid, thereby also producing better packing results. Thus, as is apparent from the Test results, lowering the $D_p/D_c$ ratio to a figure which approaches 1, produces better packing results than if the standard $D_p/D_c$ ratio of about 2.65 is used. It might be noted that this is true even if no viscosifier is used, as was the case in Test 3 versus Test 1 (the former Test also being at a greater angle to the vertical). Furthermore, as is apparent from reviewing Test 4 versus Test 2, a gravel/densified carrier liquid with a $D_p/D_c=2.0$, still functions better than the usual gravel/water slurry ($D_p/D_c=2.65$), although certainly nowhere near as well as a slurry in which the $D_pD_c=1$.

The SDVB beads, disclosed above, have chemical and physical properties (e.g., glass transition temperatures, softening points, oil solubility, etc.) that make such beads useful in packing shallow, low-pressure, low-temperature wells. Other materials which can be used, include nut shells, endocarp seeds, and particulate materials formed from known synthetic polymers. The packing material selected should obviously be able to withstand the temperature, pressure and chemical conditions which will be encountered in a well to be packed.

One particularly preferred packing material useful according to the present invention is ceramic spheres. Preferably, the ceramic spheres are inert, low density beads typically containing a multiplicity of minute independent closed air or gas cells surrounded by a tough annealed or partially annealed outer shell. As such, the average density of the ceramic beads can be selectively controlled by virture of the amount of gas cells present. Such ceramic beads are usually impermeable to water and other fluids and being ceramic, the spheres are functional at extremely high temperatures. Optionally, the outer surface of such ceramic spheres can be coated to provide optimum physical and chemical properties. Ceramic spheres of this nature are supplied commercially by 3M Company, St. Paul, Minn., under the trade name MACROLITE.

Typically, the ceramic bead packing materials useful in accordance with the present invention are preferably characterized by the desired particle size distribution (i.e., U.S. Mesh 8-80); a density or average specific gravity of from about 1.0 to about 2.0 g/cm$^3$ and preferably, from 1.3 to 1.5 g/cm$^3$ with a deviation from average of ±0.1 maximum (ASTM D792); a roundness and sphericity greater than 0.6 (API RP58, §4); a crush resistance after 2 minutes at 2,000 psi of less than 2.0 wt. % (API HSP, procedure 7); a mud acid and 15% HCl solubility of less than 2.0 wt. % (ASTM C146); a compressive strength of at least 10,000 psi (ASTM D695); a deflection temperature of at least 250° F. at 264 psi (ASTM D648); and UL continuous use rating of at least 275° F. (ULS 746B). Furthermore, the ceramic bead packing materials should be sufficiently resistant to brine, aliphatic hydrocarbons and aromatic hydrocarbons to allow continuous emersion at elevated temperatures. Preferably, the materials should be sufficiently resistant to acids to allow short exposures to acids such as HCl, HF and mixtures or the like.

To improve or meet the chemical resistance and physical properties, the ceramic spheres can preferably be coated with various polymers or the like, including by way of example, but not limited thereto: epoxides, various thermoplastics, such as polyamides, polyamide-imides, polyimides, polytetrafluoroethylene or other related fluorinated polymers, polyolefins, polyvinyls; and the like. For high temperature applications, coatings of sulfone polymers, fluoroplastics, polyamide-imides, homopolyester and polyetherether ketones are particularly useful.

To illustrate that the same SDVB particles can be used in a slurry in which they were provided with a coating of adhesive, a consolidated mass of the particles (referred to below as a "core") was prepared using the following procedure:

Carrying Fluid Preparation

1. Take a clean, dry 1-gallon vessel.
2. Add 3000 g. of cool tap water.
3. Add 60 g. of potassium chloride (KCl).
4. Position the vessel under a mixer equipped with an anchor stirrer.
5. Adjust stirring rate (RPM) to permit maximum mixing without entraining air.
6. Add 25.9 g. of a viscosifier.
7. Allow solution to mix for five minutes in order to completely disperse the viscosifier.
8. Add 7.11 g. of Tetrasodium ethylenediaminetetraacetic acid (EDTA).
9. Reduce mixer speed to about 50 RPM and mix for 30 minutes.

12. Remove stirrer from vessel and seal.

Slurry Preparation

The slurry was prepared in 32 ounce wide mouth sample jars using an anchor stirrer blade and a mixer.

1. Add 297 g. of carrying liquid and 240 g. of SDVB beads U.S. Sieve No. 18-50 (i.e. material will pass through U.S. No. 18 Sieve but will be retained on U.S. No. 50 Sieve.
2. Adjust stirrer RPM to about 100 RPM and mix for five minutes.
3. Add 42.4 ml of 40 wt. % (based on solution) epoxy resin in diethylene glycol methyl ether solution.
4. Add 14.1 ml of a polyamine curing agent prepared by the method disclosed in U.S. Pat. No. 4,247,430.
5. Add 1.4 ml of N,N-dimethylaminomethylphenol (primarily a mixture of meta and para isomers).
6. Mix for thirty minutes.

Core Preparation

Consolidated resin coated gravel cores are prepared using 60 ml LEUR-LOCK syringes with the plungers notched to permit air escape. Eighty mesh wire cloth is inserted into the syringe prior to sample addition in order to retain the SDVB particles. Sixty ml of slurry is added to the syringe, the plunger is inserted, and the core is compacted. Compaction by hand is completed by maintaining about 90 lb. force on the plunger for 10 seconds. The syringe is then capped and placed in a hot water bath. The cores are then cured for the desired time interval, removed from the bath and washed by forcing hot tap water through the core several times. The cores are then removed from the syringe and either sawed into 2¼ inch lengths for compressive strength determination, and into 1 inch lengths for permeability determination. The measured compressive strength was 673 psi, while the permeability was 32 Darcies. Thus, it is apparent that SDVB particles provided with an adhesive coating could act in the method of the present invention, to provide a consolidated particulate mass in a well packing job.

Various modifications and alterations to the embodiments of the invention described above, will be apparent to those skilled in the art. Accordingly, the scope of the present invention is to be construed from the following claims, read in light of the foregoing disclosure.

I claim:

1. A method of packing a well, a portion of which penetrates an earth formation at an angle to the vertical, comprising:
   (a) injecting into the wellbore a slurry of particles in a liquid, the slurry having a particle density to liquid density ratio of no greater than about 2 to 1, and the particles having a coating of adhesive; and
   (b) straining the particles out of the slurry so as to produce a packed mass of the particles adjacent the formation, which packed mass will allow flow of fluids between the formation and wellbore, while substantially preventing particulate material from the formation passing therethrough and into the wellbore.

2. A method as defined in claim 1, wherein the the adhesive requires treatment with a catalyst before becoming effective, the method additionally comprising pumping a catalyst down the bore after the particles have been strained out, so as to activate the adhesive and consolidate the packed mass.

3. A method as defined in claim 1 wherein the adhesive will set over time following straining out of the particles.

4. A method as defined in claim 1, wherein the density of the particles is less than about 2 g/cm$^3$.

5. A method as defined in claim 1, wherein the density of the particles is between about 0.7 to about 2 g/cm$^3$.

6. A method as defined in claim 1 wherein the liquid has a density of about 0.8 to about 1.2 g/cm$^3$.

7. A method as defined in claim 5 wherein the liquid contains a friction reducer.

8. A method as defined in claim 5, wherein the particles have a Krumbein roundness and sphericity each of at least about 0.5.

9. A method as defined in claim 5, wherein the particles have a Krumbein roundness and sphericity each of at least about 0.6.

10. A method as defined in claim 5 wherein the portion of the bore which is packed, passes through the formation at an angle to the vertical of greater than about 45°.

11. A method of packing a well a portion of which penetrates an earth formation at an angle to the vertical of greater than comprising:
   (a) injecting into the bore a slurry of particles in a liquid, the slurry having a particle density to liquid density ratio of no greater than about 2 to 1, and the particles having a coating of adhesive, having a density of between about 0.8 to about 1.2 g. cm$^{-3}$, and having a Krumbein roundness and sphericity of at least about 0.6;
   (b) straining the particles out of the slurry so as to produce a packed mass of the particles at that portion of the well, which packed mass will allow production of fluids therethrough from the formation into the bore, while substantially preventing particulate material from the formation passing therethrough and into the well during such production.

12. A method as defined in claim 11, wherein the liquid is unviscosified water.

13. A method of packing a well a portion of which penetrates an earth formation at an angle to the vertical, and which portion has placed therein a perforated casing and production screen, the method comprising:
   (a) injecting into the bore a slurry of particles in a liquid, the slurry having a particle density to liquid density ratio of no greater than about 2 to 1, and the particles having a coating of adhesive, having a density of between about 0.8 to about 1.2, and having a Krumbein roundness and sphericity of at least about 0.6;
   (b) straining the particles out of the slurry so as to produce a packed mass of the particles at that portion of the well, which packed mass substantially completely fills a volume which includes the annular space between the screen and the casing, and the majority of perforations extending through the casing, and will allow production of fluids therethrough from the formation into the bore, while substantially preventing particulate material from the formation passing therethrough and into the well during such production.

14. A method of packing a well a portion of which penetrates an earth formation at an angle to the vertical of greater than 45°, and which portion has placed therein a perforated casing and production screen, the method comprising:

(a) injecting into the bore a slurry of particles in a liquid, the slurry having a particle density to liquid density ratio of no greater than about 2 to 1, and the particles having a coating of adhesive, having a density of between about 0.8 to about 1.2, and having a Krumbein roundness and sphericity of at least about 0.6;

(b) straining the particles out of the slurry so as to produce a packed mass of the particles at that portion of the well, which packed mass substantially completely fills a volume which includes the annular space between the screen and the casing, and the majority of perforations extending through the casing, and will allow production of fluids therethrough from the formation into the bore, while substantially preventing particulate material from the formation passing therethrough and into the well during such production.

15. A method of packing a well comprising, (a) injecting into the wellbore a slurry of particles in a liquid, the slurry having a particle density to liquid density ratio of no greater than 1.5 to 1, and the particles having a coating of surface adhesive; and (b) straining the particles out of the slurry so as to produce a packed mass of the particles adjacent the formation, which packed mass will allow flow of fluids therethrough between the formation and wellbore, while substantially preventing particulate material from the formation passing therethrough and into the wellbore.

16. A method as defined in claim 15 wherein the liquid has a density of about 0.8 to about 1.2 g/cm$^3$.

17. A method as defined in claim 16, wherein the particles have a Krumbein roundness and sphericity each of at least about 0.6

18. A method as defined in claim 1 where said particles are ceramic spheres, characterized by an average density of about 1.0 to about 2.0 g/cm$^3$.

19. A method as defined in claim 11 wherein said particles are ceramic spheres characterized by an average density of about 1.0 to about 2.0 g/cm$^3$.

20. A method as defined in claim 13 where said particles are ceramic spheres characterized by an average density of about 1.0 to about 2.0 g/cm$^3$.

21. A method as defined in claim 14 where said particles are ceramic spheres characterized by an average density of about 1.0 to about 2.0 g/cm$^3$.

22. A method as defined in claim 15 where said particles are ceramic spheres characterized by an average density of about 1.0 to about 2.0 g/cm$^3$.

23. A method of packing a well comprising:

(a) injecting into the wellbore a slurry of particles in a liquid, the slurry having a particle density to liquid density ratio of no greater than about 2 to 1, and the particles having a coating of adhesive; and (b) straining the particles out of the slurry so as to produce a packed mass of the particles adjacent to the formation, which packed mass will allow flow of fluids between the formation and wellbore, while substantially preventing particulate material from the formation passing therethrough and into the wellbore.

24. A method as defined in claim 23 wherein said particles are ceramic spheres characterized by an average density of about 1.0 to about 2.0 g/cm$^3$.

25. A method as defined in claim 24 wherein the liquid is unviscosified water.

* * * * *